US008550457B2

(12) United States Patent
Wang

(10) Patent No.: US 8,550,457 B2
(45) Date of Patent: Oct. 8, 2013

(54) PAPER FEEDING MODULE AND MULTI-FUNCTION PRINTER USING THE SAME

(75) Inventor: Kuo-Ming Wang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/533,991

(22) Filed: Jun. 27, 2012

(65) Prior Publication Data

US 2013/0049295 A1 Feb. 28, 2013

(30) Foreign Application Priority Data

Aug. 26, 2011 (TW) ..... 100130721 A

(51) Int. Cl.
*G03G 15/00* (2006.01)

(52) U.S. Cl.
USPC ..... 271/242; 399/395

(58) Field of Classification Search
USPC ..... 271/242; 399/395, 307, 316, 388
See application file for complete search history.

(56) References Cited

U.S. PATENT DOCUMENTS

| | | | | |
|---|---|---|---|---|
| 4,300,756 | A * | 11/1981 | Danchak et al. | 271/8.1 |
| 5,169,140 | A | 12/1992 | Wenthe, Jr. | |
| 5,819,153 | A * | 10/1998 | Lim | 399/388 |
| 5,947,617 | A | 9/1999 | Kondo | |
| 2009/0243200 | A1 | 10/2009 | Chen et al. | |

FOREIGN PATENT DOCUMENTS

| | | | | |
|---|---|---|---|---|
| JP | 06246990 | A * | 9/1994 | B41J 13/00 |

* cited by examiner

*Primary Examiner* — Jeremy R Severson
(74) *Attorney, Agent, or Firm* — Jianq Chyun IP Office

(57) ABSTRACT

A paper feeding module and multi-function printer using the same are provided. The multi-function printer includes a body, a paper transferring passage and a paper feeding module. The paper transferring passage includes an entrance. The paper feeding module includes a photoreceptor axle, a transferring axle and a skew correction axle. The photoreceptor axle is disposed on the paper transferring passage. The transferring axle is disposed next to the photoreceptor axle and contacts the photoreceptor axle. The skew correction axle is disposed between the entrance of the paper transferring passage and the photoreceptor axle. The skew correction axle contacts the transferring axle. The axes of the photoreceptor axle, the transferring axle and the skew correction axle are parallel to one another.

33 Claims, 5 Drawing Sheets

PAPER FEEDING MODULE AND MULTI-FUNCTION PRINTER USING THE SAME

CROSS-REFERENCE TO RELATED APPLICATION

This application claims the priority benefit of Taiwan application serial no. 100130721, filed on Aug. 26, 2011. The entirety of the above-mentioned patent application is hereby incorporated by reference herein and made a part of this specification.

BACKGROUND OF THE INVENTION

1. Field of the Invention

The invention is related to a paper feeding module and a multi-function printer, and particularly to a paper feeding module and a multi-function printer using the same that can prevent paper from skewing.

2. Description of Related Art

As technology improves, office automatic equipment such as scanners, photocopiers, or printers are necessary information equipment. Office equipment has gradually become multi-functional, wherein the function of printing a computer output document has become a basic necessity. However, when disposed in an office, the aforesaid various kinds of office automation equipment occupy a great deal of space. As a result, a multi-function printer (MFP) integrated with functions such as copying, printing, and scanning is developed to resolve the above problem.

When a general multi-function printer receives paper, the paper may be skewed or jammed because of the differences between the mechanical structure of the machine and the properties of the paper. In order to correct the skewing of paper, a paper feeding device of the multi-function printer will adjust the paper.

FIG. 1 is a schematic cross-sectional view of a conventional multi-function printer. FIG. 2 is a schematic diagram showing the positional relationship between a portion of the components of FIG. 1. Referring to FIG. 1 and FIG. 2, a conventional multi-function printer 100 includes two skew correction axles 110, a photoreceptor axle 120, and a transferring axle 130, respectively disposed on a paper transferring passage 140 of the multi-function printer 100. The photoreceptor axle 120 is in contact with the transferring axle 130, and the two skew correction axles 110 are in contact and located between an entrance 142 of the paper transferring passage 140 and the photoreceptor axle 120. After a piece of paper 400 enters the paper transferring passage 140, it first contacts the skew correction axles 110, which do not rotate, to adjust the entering direction of the paper 400. Then the skew correction axles 110 rotate, driving the paper 400 to proceed between the photoreceptor axle 120 and the transferring axle 130 and perform printing.

SUMMARY OF THE INVENTION

The invention provides a paper feeding module that can prevent paper jamming and paper skewing.

The invention provides a multi-function printer, wherein a paper feeding module can simply, quickly and correctly adjust paper.

The invention provides a paper feeding module adapted to a paper transferring passage of a multi-function printer. The paper feeding module includes a photoreceptor axle, a transferring axle, and a skew correction axle. The photoreceptor axle is disposed on the paper transferring passage. The transferring axle is disposed next to the photoreceptor axle and contacts the photoreceptor axle. The skew correction axle is disposed between an entrance of the paper transferring passage and the photo receptor axle. The skew correction axle contacts the transferring axle. The axes of the photoreceptor axle, the transferring axle, and the skew correction axle are parallel to one another.

The invention provides a multi-function printer which includes a main body, a paper transferring passage, and the above paper feeding module. The paper transferring passage and the paper feeding module are disposed in the main body, wherein the paper transferring passage includes an entrance. The paper feeding module includes a photoreceptor axle, a transferring axle, and a skew correction axle. The photoreceptor axle is disposed on the paper transferring passage. The transferring axle is disposed next to the photoreceptor axle and contacts the photoreceptor axle. The skew correction axle is disposed between an entrance of the paper transferring passage and the photo receptor axle. The skew correction axle contacts the transferring axle. The axes of the photoreceptor axle, the transferring axle, and the skew correction axle are parallel to one another.

In an embodiment of the paper feeding module and the multi-function printer of the invention, the axle centers of the photoreceptor axle, the transferring axle, and the skew correction axle are respectively arranged to form a triangle.

In an embodiment of the multi-function printer of the invention, the multi-function printer further includes an input tray, connected to the entrance of the paper transferring passage.

In an embodiment of the paper feeding module and the multi-function printer of the invention, the paper feeding module further includes a paper feeding axle, disposed on the entrance of the paper transferring passage, used to drive a piece of paper to move along the paper transferring passage.

In an embodiment of the paper feeding module and the multi-function printer of the invention, the paper feeding module further includes a sensor, disposed between the entrance of the paper transferring passage and the skew correction axle, to detect when paper passes through.

In an embodiment of the paper feeding module and the multi-function printer of the invention, the axle centers of the photoreceptor axle, the transferring axle, and the skew correction axle are respectively arranged to form a triangle. The paper feeding module further includes a sensor, disposed between the entrance of the paper transferring passage and the skew correction axle, to detect when paper passes through.

In an embodiment of the paper feeding module and the multi-function printer of the invention, the paper feeding module further includes a motor, wherein an end of the photoreceptor axle is disposed on the motor.

In an embodiment of the paper feeding module and the multi-function printer of the invention, the paper feeding module further includes a plurality of flexible material, respectively covering the photoreceptor axle, the transferring axle, and the skew correction axle.

In an embodiment of the paper feeding module and the multi-function printer of the invention, the flexible material is plastic.

Based on the above, the invention uses a skew correction axle, disposed between the entrance of the paper transferring passage and the photoreceptor axle. The skew correction axle is disposed parallel to the transferring axle and contacts the transferring axle. This way, the invention uses three axles to accomplish the functions of skew correcting and transferring. Not only does this reduce the required length of the paper transferring passage, the volume and operation time of the multi-function printer is reduced.

In order to make the aforementioned and other features and advantages of the invention more comprehensible, embodiments accompanying figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Figure 1:
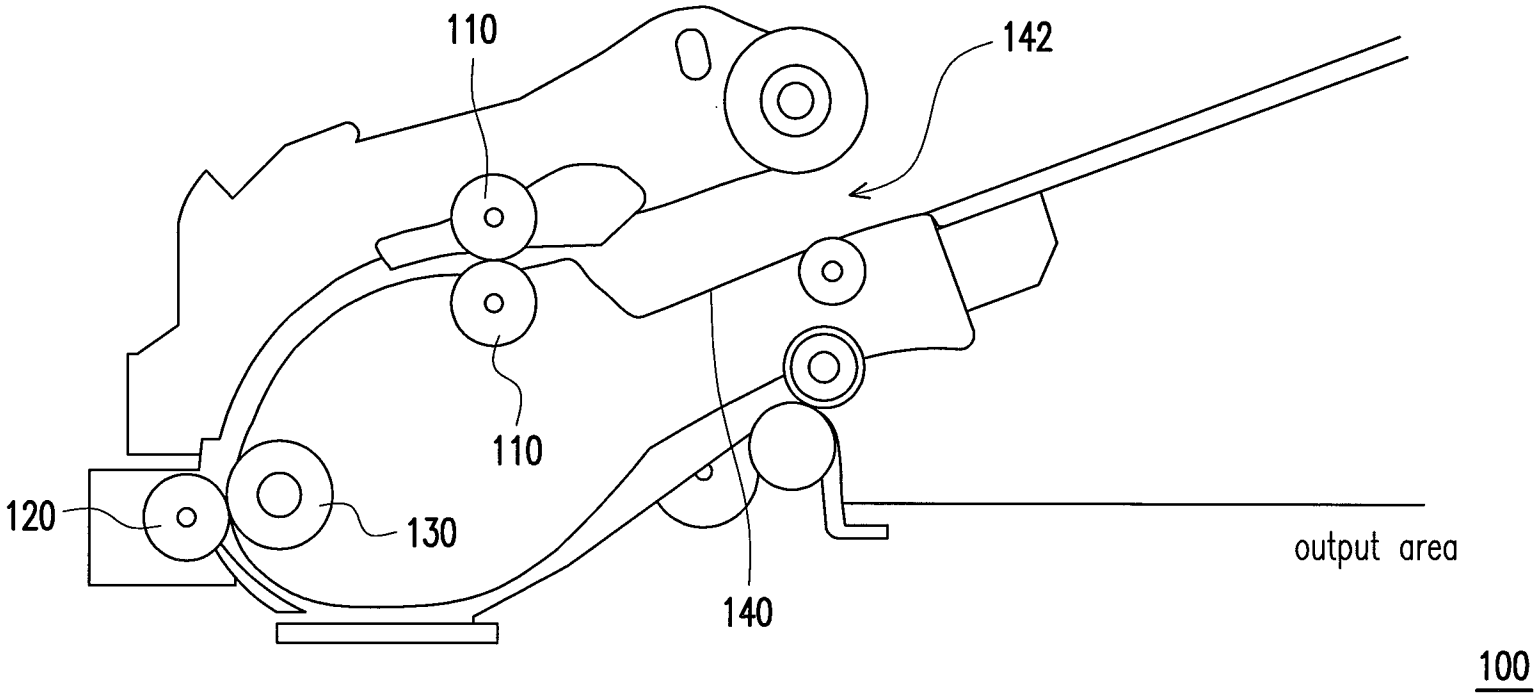
FIG. 1 (PRIOR ART)
FIG. 1 is a schematic cross-sectional view of a conventional multi-function printer.
Figure 2:
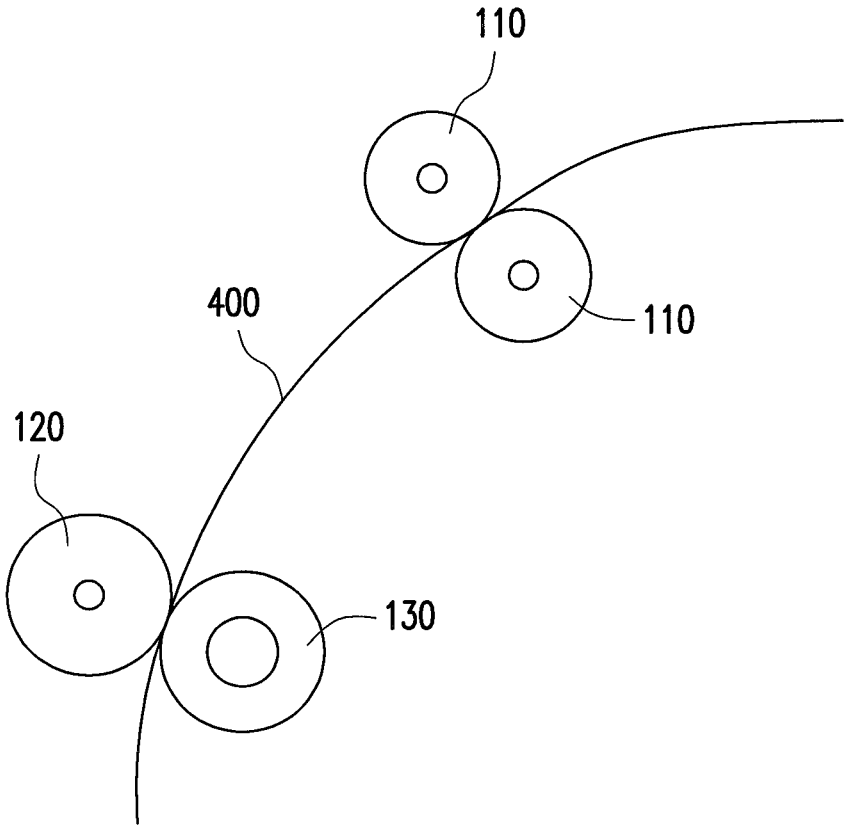
FIG. 2 (PRIOR ART)
FIG. 2 is a schematic diagram showing the positional relationship between a portion of the components of FIG. 1.
Figure 3:
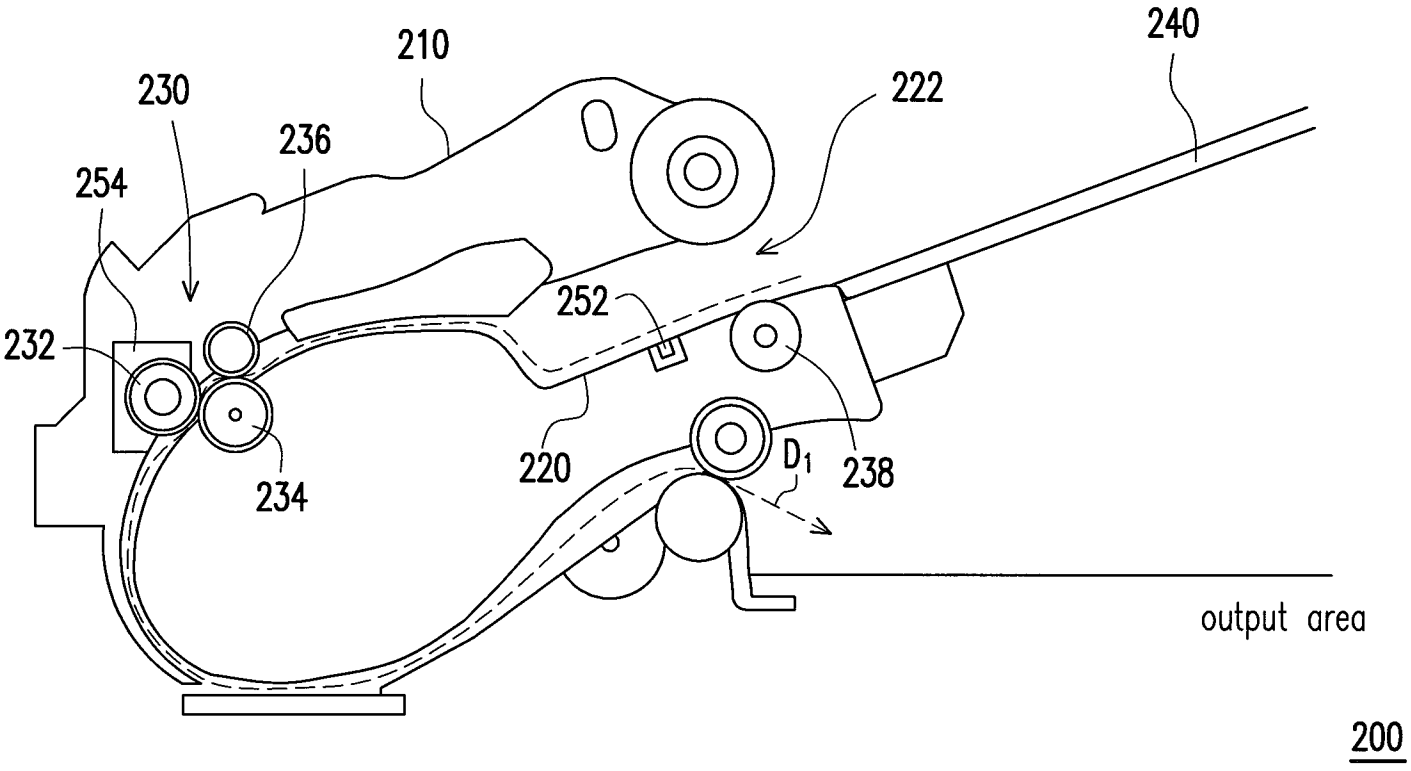
FIG. 3 is a schematic cross-sectional view of a multi-function printer according to an embodiment of the invention.
Figure 4:
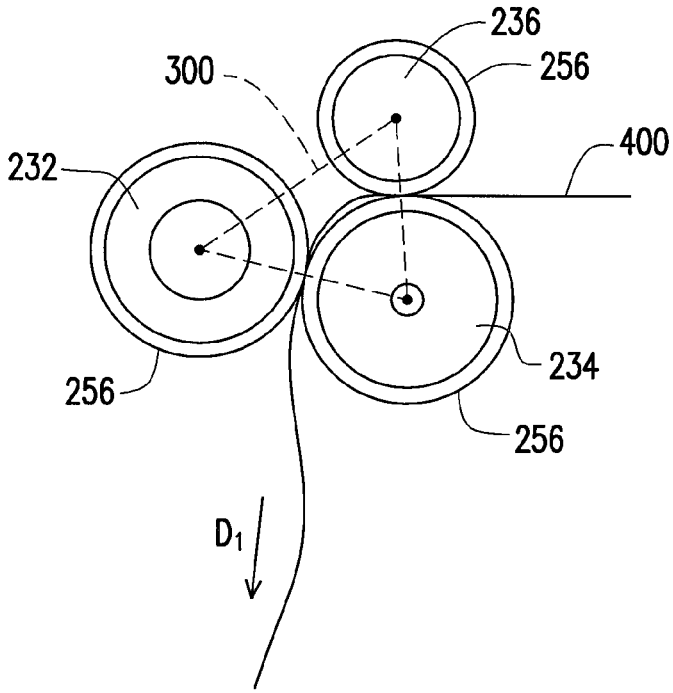
FIG. 4 is a schematic diagram showing the positional relationship between a photoreceptor axle, a transferring axle, and a skew correction axle of FIG. 3.

FIG. 3 is a schematic cross-sectional view of a multi-function printer according to an embodiment of the invention. FIG. 4 is a schematic diagram showing the positional relationship between a photoreceptor axle, a transferring axle, and a skew correction axle of FIG. 3. Referring to FIG. 3 and FIG. 4, in an embodiment of the invention, the multi-function printer includes a main body 210, a paper transferring passage 220, a paper feeding module 230, and an input tray 240. The paper transferring passage 220 includes an entrance 222. The input tray 240 is connected to the entrance 222 of the paper transferring passage 220. The paper feeding module 230 includes a photoreceptor axle 232, a transferring axle 234, a skew correction axle 236, and a paper feeding axle 238. The photoreceptor axle 232 is disposed on the paper transferring passage 220. The transferring axle 234 is disposed next to the photoreceptor axle 232 and contacts the photoreceptor axle 232. The skew correction axle 236 is disposed between the entrance 222 of the paper transferring passage 220 and the photo receptor axle 232. The skew correction axle 236 contacts the transferring axle 234. The axes of the photoreceptor axle 232, the transferring axle 234, and the skew correction axle 236 are parallel to one another. The axle centers of the photoreceptor axle 232, the transferring axle 234, and the skew correction axle 236 are respectively arranged to form a triangle 300. The triangle 300 can be an acute triangle, a right triangle, or an obtuse triangle. The type of triangle 300 can be changed according to need. In addition, the paper feeding axle 238 is disposed on the entrance 222 of the paper transferring passage 220. It is used to drive a piece of paper 400 to move along a paper transferring direction D1, and send the piece of paper 400 to the paper transferring passage 220 of the multi-function printer 200.

The paper feeding module 230 of the embodiment further includes a sensor 252 and a motor 254. An end of the photoreceptor axle 232 is disposed on the motor 254. The sensor 252 is disposed between the entrance 222 of the paper transferring passage 220 and the skew correction axle 236. The sensor 252 is used to detect whether or not a piece of paper 400 has passed through and entered the paper transferring passage 220, and transmits a signal to the motor 254. This controls when the motor 254 starts, and the motor is used to drive the photoreceptor axle 232 to rotate. When the photoreceptor axle 232 is driven to rotate, the transferring axle 234 in contact with the photoreceptor axle 232 will also rotate, in turn causing the skew correction axle 236 to be driven to rotate. It should be noted that the driving relationship between the photoreceptor axle 232, the transferring axle 234, and the skew correction axle 236 is accomplished through a linkage (such as a gear set) respectively related to the photoreceptor axle 232, the transferring axle 234, and the skew correction axle 236. One skilled in the art can change and adjust according to need without departing from the scope and spirit of the embodiment.

The paper feeding module 230 further includes a plurality of flexible material 256, respectively covering the photoreceptor axle 232, the transferring axle 234, and the skew correction axle 236. The material of the flexible material 256 can be a thermoplastic flexible body, such as plastic. However, the invention is not limited thereto. The material can be any suitable flexible material. The use of the flexible material 256 can increase the flexibility of the photoreceptor axle 232, the transferring axle 234, and the skew correction axle 236, and reduces warpage or creasing of paper 400.

When paper 400 enters the paper transferring passage 220 through the driving of the paper feeding axle 238, the sensor 252 located between the entrance 222 and the skew correction axle detects the paper 400 passing through, and transmits a signal to the motor 254. At this point the photoreceptor axle 232, the transferring axle 234, and the skew correction axle 236 have not yet started to rotate, and the paper 400 is continually driven by the paper feeding axle 238 to move forward along the paper transferring direction D1 and make contact with the non-rotating skew correction axle 236 and transferring axle 234.

Figure 5:
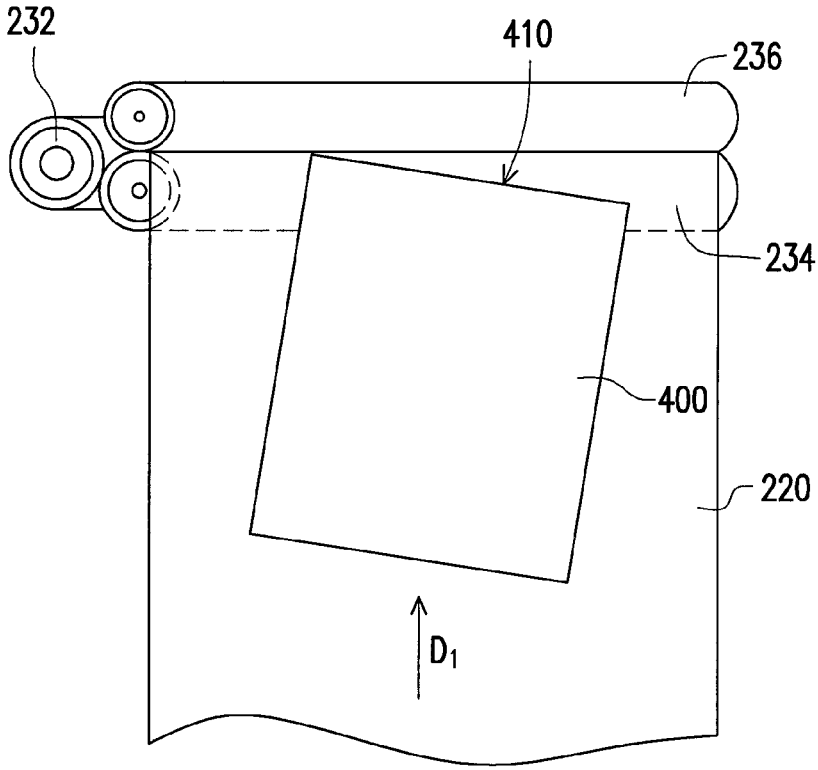
FIG. 5 is a schematic diagram of the skew correction axle of FIG. 3 adjusting the position of a piece of paper.

FIG. 5 is a schematic diagram of the skew correction axle of FIG. 3 adjusting the position of a piece of paper. Referring to FIG. 5, if the paper 400 is crooked, meaning a side 410 of the paper 400 is not completely in contact with the skew correction axle 236 and the transferring axle 234, a portion of the side 410 that is in contact with the skew correction axle 236 will be blocked by the skew correction axle 236 to stop moving forward. A portion of the side 410 that is not in contact with the skew correction axle 236 will continue to be driven by the paper feeding axle 238 to move forward. This is done until the entire side 410 of the paper 400 is completely in contact with the skew correction axle 236, to achieve a skew correction effect.

Referring to FIG. 3 and FIG. 4, at this point the signal of detection transmitted to the motor 254 by the sensor 252 starts the motor 254. This drives the photoreceptor axle 232 to rotate. The transferring axle 234 in contact with the photoreceptor axle 232 and the skew correction axle 236 in contact with the transferring axle 234 will also start to rotate because of the mutual engaging of gears. This continues to drive the paper 400 to pass through the skew correction axle 236, and enter between the transferring axle 234 and the photoreceptor axle 232 to perform transferring.

With this configuration, the skew correction axle 236, the transferring axle 234, and the photoreceptor axle 232 are disposed together. This way, the transferring axle 234 can replace one of the pair of conventional skew correction axles, and still achieve a skew correction effect. In addition, the skew correction axle 236, the transferring axle 234, and the photoreceptor axle 232 are disposed together, which allows the paper 400 to directly enter a printing process after skew correction. This process is shorter compared to the conventional paper transferring passage of paper 400, and further reduces the volume of the multi-function printer 200.

Figure 6:
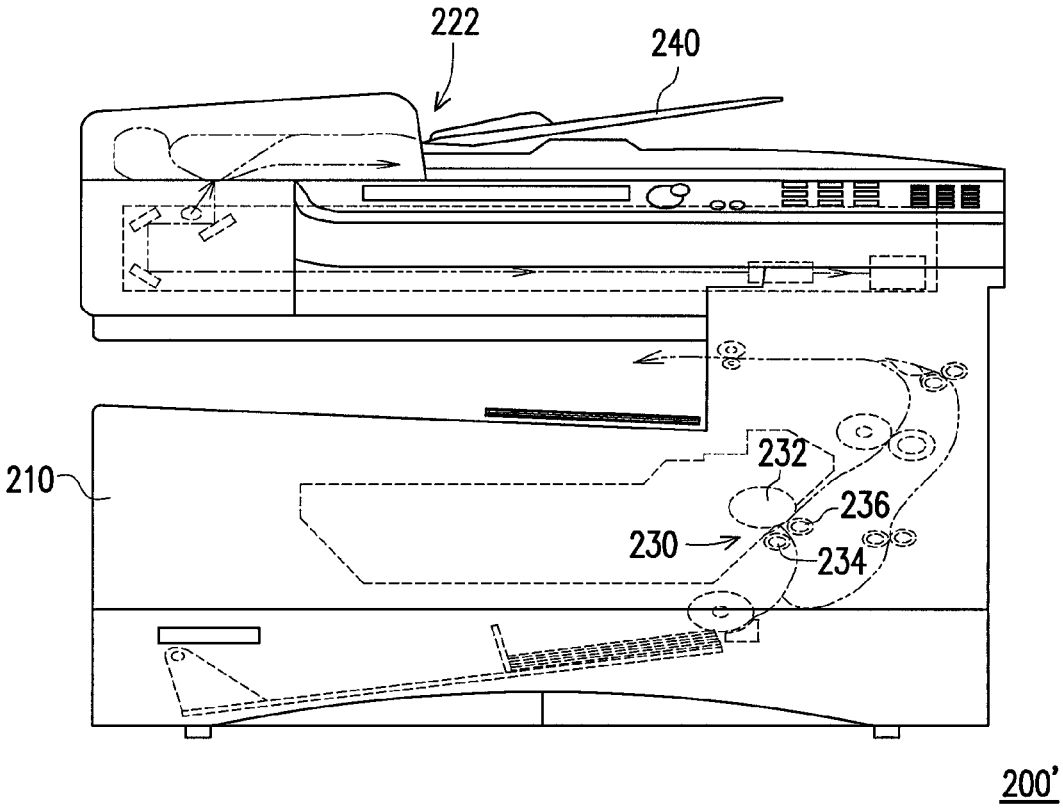
FIG. 6 is a schematic view of a multi-function printer according to another embodiment of the invention.

FIG. 6 is a schematic view of a multi-function printer according to another embodiment of the invention. Current multi-function printers usually include the functions of a printer and an automatic paper feeding scanner. Referring to FIG. 6, the multi-function printer 200 of the embodiment includes the function of an automatic paper feeding printer and scanner. The paper feeding module 230 can be located in the position shown in FIG. 6, and execute the skew correction and transferring tasks.

To sum up, the invention uses a skew correction axle, disposed between the entrance of the paper transferring passage and the photoreceptor axle. The skew correction axle is in contact with a transferring axle. Thus, the assembly of three linked axles can replace the conventional configuration of two pairs of separated axles, and still achieve the functions of skew correction and transferring. Therefore, not only does the invention reduce the required length of the paper transferring passage and the operation time of the multi-function printer, but it also saves the power and space required for the multi-function printer by using a single motor to drive three axles.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A paper feeding module, adapted to a paper transferring passage of a multi-function printer, the paper feeding module comprising:

a photoreceptor axle, disposed on the paper transferring passage;

a transferring axle, disposed next to the photoreceptor axle and contacting the photoreceptor axle; and a skew correction axle, disposed between an entrance of the paper transferring passage and the photoreceptor axle, and contacting the transferring axle, wherein an axis of the photoreceptor axle, an axis of the transferring axle, and an axis the skew correction axle are parallel to one another, the skew correction axle and the transferring axle are respectively disposed at two opposite side of the paper transferring passage.

2. The paper feeding module as claimed in claim 1, wherein an axle center of the photoreceptor axle, an axle center of the transferring axle, and an axle center of the skew correction axle are respectively arranged to form a triangle.

3. The paper feeding module as claimed in claim 2, further comprising a sensor, disposed between the entrance of the paper transferring passage and the skew correction axle, so as to detect when a piece of paper passes through.

4. The paper feeding module as claimed in claim 3, further comprising a motor, wherein an end of the photoreceptor axle is disposed on the motor.

5. The paper feeding module as claimed in claim 3, further comprising a plurality of flexible material, respectively covering the photoreceptor axle, the transferring axle, and the skew correction axle.

6. The paper feeding module as claimed in claim 2, further comprising a motor, wherein an end of the photoreceptor axle is disposed on the motor.

7. The paper feeding module as claimed in claim 2, further comprising a plurality of flexible material, respectively covering the photoreceptor axle, the transferring axle, and the skew correction axle.

8. The paper feeding module as claimed in claim 1, further comprising a paper feeding axle, disposed on the entrance of the paper transferring passage, adapted to drive a piece of paper to move along the paper transferring passage.

9. The paper feeding module as claimed in claim 8, further comprising a motor, wherein an end of the photoreceptor axle is disposed on the motor.

10. The paper feeding module as claimed in claim 8, further comprising a plurality of flexible material, respectively covering the photoreceptor axle, the transferring axle, and the skew correction axle.

11. The paper feeding module as claimed in claim 1, further comprising a sensor, disposed between the entrance of the paper transferring passage and the skew correction axle, so as to detect when a piece of paper passes through.

12. The paper feeding module as claimed in claim 11, further comprising a motor, wherein an end of the photoreceptor axle is disposed on the motor.

13. The paper feeding module as claimed in claim 11, further comprising a plurality of flexible material, respectively covering the photoreceptor axle, the transferring axle, and the skew correction axle.

14. The paper feeding module as claimed in claim 1, further comprising a motor, wherein an end of the photoreceptor axle is disposed on the motor.

15. The paper feeding module as claimed in claim 1, further comprising a plurality of flexible material, respectively covering the photoreceptor axle, the transferring axle, and the skew correction axle.

16. The paper feeding device as claimed in claim 15, wherein the flexible material is plastic.

17. A multi-function printer, comprising:

a main body;

a paper transferring passage, disposed in the main body, and having an entrance; and a paper feeding module, disposed in the main body, comprising:

a photoreceptor axle, disposed on the paper transferring passage;

a transferring axle, disposed next to the photoreceptor axle and contacting the photoreceptor axle; and a skew correction axle, disposed between the entrance of the paper transferring passage and the photoreceptor axle, and contacting the transferring axle, wherein an axis of the photoreceptor axle, an axis of the transferring axle, and an axis of the skew correction axle are parallel to one another, the skew correction axle and the transferring axle are respectively disposed at two opposite side of the paper transferring passage.

18. The multi-function printer as claimed in claim 17, wherein an axle center of the photoreceptor axle, an axle center of the transferring axle, and an axle center of the skew correction axle are respectively arranged to form a triangle.

19. The multi-function printer as claimed in claim 18, wherein the paper feeding module further comprises a sensor, disposed between the entrance of the paper transferring passage and the skew correction axle, so as to detect a duration of a piece of paper passes through.

20. The multi-function printer as claimed in claim 18, wherein the paper feeding module further comprises a motor, and an end of the photoreceptor axle is disposed on the motor.

21. The multi-function printer as claimed in claim 18, wherein the paper feeding module further comprises a plurality of flexible material, respectively covering the photoreceptor axle, the transferring axle, and the skew correction axle.

22. The multi-function printer as claimed in claim 17, further comprising an input tray, connected to the entrance of the paper transferring passage.

23. The multi-function printer as claimed in claim 22, wherein the paper feeding module further comprises a motor, and an end of the photoreceptor axle is disposed on the motor.

24. The multi-function printer as claimed in claim 22, wherein the paper feeding module further comprises a plurality of flexible material, respectively covering the photoreceptor axle, the transferring axle, and the skew correction axle.

25. The multi-function printer as claimed in claim 17, wherein the paper feeding module further comprises a paper feeding axle, disposed on the entrance of the paper transferring passage, adapted to drive a piece of paper to move along the paper transferring passage.

26. The multi-function printer as claimed in claim 25, wherein the paper feeding module further comprises a motor, and an end of the photoreceptor axle is disposed on the motor.

27. The multi-function printer as claimed in claim 25, wherein the paper feeding module further comprises a plurality of flexible material, respectively covering the photoreceptor axle, the transferring axle, and the skew correction axle.

28. The multi-function printer as claimed in claim 17, wherein the paper feeding module further comprises a sensor, disposed between the entrance of the paper transferring passage and the skew correction axle, so as to detect a duration of a piece of paper passes through.

29. The multi-function printer as claimed in claim 28, wherein the paper feeding module further comprises a motor, and an end of the photoreceptor axle is disposed on the motor.

30. The multi-function printer as claimed in claim 28, wherein the paper feeding module further comprises a plurality of flexible material, respectively covering the photoreceptor axle, the transferring axle, and the skew correction axle.

31. The multi-function printer as claimed in claim 17, wherein the paper feeding module further comprises a motor, and an end of the photoreceptor axle is disposed on the motor.

32. The multi-function printer as claimed in claim 17, wherein the paper feeding module further comprises a plurality of flexible material, respectively covering the photoreceptor axle, the transferring axle, and the skew correction axle.

33. The multi-function printer as claimed in claim 32, wherein the flexible material is plastic.

* * * * *